US005788194A

United States Patent [19]

Van Den Berg

[11] Patent Number: 5,788,194

[45] Date of Patent: Aug. 4, 1998

[54] METHOD AND APPARATUS FOR SEALING A TUBULAR DISPENSER

[76] Inventor: Henry J. Van Den Berg, 4106 Romence Rd., Portage, Mich. 49024

[21] Appl. No.: 756,005

[22] Filed: Nov. 25, 1996

Related U.S. Application Data

[60] Provisional application No. 60/021,473 Jul. 10, 1996.

[51] Int. Cl.[6] ..... B65D 35/56

[52] U.S. Cl. ..... 248/109; 248/311.3; 211/70.6

[58] Field of Search ..... 211/70.6, 69.5, 211/69.1; 206/384, 207; 248/109, 311.3

[56] References Cited

U.S. PATENT DOCUMENTS

| | | | |
|---|---|---|---|
| 30,270 | 10/1860 | Warren | 211/69.5 X |
| D. 37,722 | 12/1905 | Benziger | 211/69.5 X |
| 283,389 | 8/1883 | Goodwin . | |
| 320,141 | 6/1885 | Keck . | |
| 340,859 | 4/1886 | Carley . | |
| 566,330 | 8/1896 | Marsden . | |
| 648,928 | 5/1900 | Davis . | |
| 902,166 | 10/1908 | Perlich . | |
| 1,451,119 | 4/1923 | Schroeder et al. | 248/311.3 X |
| 1,575,231 | 3/1926 | Seltmann | 248/109 X |
| 1,742,150 | 12/1929 | Rollins | 248/311.3 X |
| 1,827,731 | 10/1931 | Churchhill | 211/70.1 X |
| 2,011,040 | 8/1935 | Cuthbert | 211/69.5 X |
| 2,091,518 | 8/1937 | Murphy | 248/311.3 X |
| 2,225,138 | 12/1940 | Traylor, Jr. . | |
| 2,666,967 | 1/1954 | Poitras . | |
| 2,689,066 | 9/1954 | Budnik | 248/311.3 X |
| 3,176,662 | 4/1965 | Williams . | |
| 3,239,069 | 3/1966 | Hollins . | |
| 3,428,380 | 2/1969 | Danjczek . | |
| 3,463,323 | 8/1969 | Riepe | 211/69.5 |
| 3,862,683 | 1/1975 | Koelichen . | |
| 3,866,992 | 2/1975 | Katz . | |
| 4,090,612 | 5/1978 | Lostutter . | |
| 4,090,613 | 5/1978 | McPherson | 211/69.5 |
| 4,326,648 | 4/1982 | Kieber | 248/311.3 X |
| 4,374,565 | 2/1983 | Neumann | 211/69.5 |
| 4,439,884 | 4/1984 | Giorni | 211/70.6 |
| 5,033,629 | 7/1991 | Caine | 211/69.5 |
| 5,080,240 | 1/1992 | Williams | 211/70.6 |
| 5,232,103 | 8/1993 | Koenig et al. . | |

FOREIGN PATENT DOCUMENTS

| | | | |
|---|---|---|---|
| 442787 | 6/1912 | France | 211/69.5 |
| 907261 | 6/1945 | France | 248/109 |
| 2037665 | 2/1972 | Germany | 211/69.5 |
| 524648 | 2/1940 | United Kingdom | 211/69.5 |

*Primary Examiner*—Jose V. Chen
*Assistant Examiner*—David E. Allred
*Attorney, Agent, or Firm*—Price, Heneveld, Cooper, DeWitt & Litton

[57] ABSTRACT

A device for sealing the open tip of a tubular dispenser is disclosed including one tubular member closed at one end and having an inside diameter sufficient to receive the dispenser and adapted to receive a liquid therein for immersing the tip of the dispenser when located in the receptacle.

11 Claims, 3 Drawing Sheets

METHOD AND APPARATUS FOR SEALING A TUBULAR DISPENSER

CROSS REFERENCE TO RELATED APPLICATION

This application claims priority under 35 U.S.C. § 119(e) to U.S. Provisional application Ser. No. 60/021,473, filed Jul. 10, 1996, entitled METHOD AND APPARATUS FOR SEALING A TUBULAR DISPENSER, the entire disclosure of which is herein incorporated by reference.

BACKGROUND OF THE INVENTION

The present invention relates generally to tubular dispensers, and more particularly to a device for storing tubular dispensers which at the same time seals the open tip of the dispenser.

Caulking compounds are generally used to fill joints or cracks where a generally weather tight seal is needed. Most caulk tubes and other tubular dispensers are equipped with a nozzle tip which is opened to dispense the caulking compound to the joint as needed. Once opened, the tube itself has no means for re-sealing the tip. Because there is no means for re-closing the tip, in the past a nail has been used to effectively seal the tip once the tube is put in storage. This is done because after a short period of exposure to the air, the compound inside the tube dries out. The drying of the compound inside the tube renders the apparatus virtually unusable because once the compound dries it will no longer flow out of the tube.

A similar problem has occurred with writing instruments, especially ones that use India ink. When the tip of the ink pen dries out, the tip must be re-moistened for ink to effectively flow again. The ink pen problem has been solved by a receptacle with a pool of ink at the bottom whereby the pool of ink kept the tip from drying out. However, no such prior art solves the problem of the drying out of a compound in a tube. There is a desire to have a device that will effectively retain the moisture of the compound inside the tube.

SUMMARY OF THE PRESENT INVENTION

Accordingly, it is the object of the present invention to solve the problem of sealing the compound in the tube. Moreover, the present invention provides a place for storage of tubular dispensers in an upright or slightly angled position.

In one embodiment, a tube sealer embodying the invention is comprised of a base member, tubular receptacles, and a fluid. A disk insert may be provided inside the tubular receptacles. The disk insert contains a hole in the middle so as to receive the tip of the tube. The tip of the tube is placed into the receptacle containing the liquid, with the opening in the tip entirely immersed in fluid, which prevents the compound from drying out.

In an alternative embodiment, the tube sealer of the invention is a single-piece molded structure. The tubular receptacles each have a conical shaped recess to receive the opened tip of a caulk tube in place of the disk insert of the other embodiment.

These and other features, objects and advantages of the present invention will become apparent upon reading the following description thereof together with reference to the accompanying drawings.

BRIEF DESCRIPTION OF THE DRAWING FIGURES

DETAILED DESCRIPTION OF THE PREFERRED EMBODIMENTS

Figure 1:
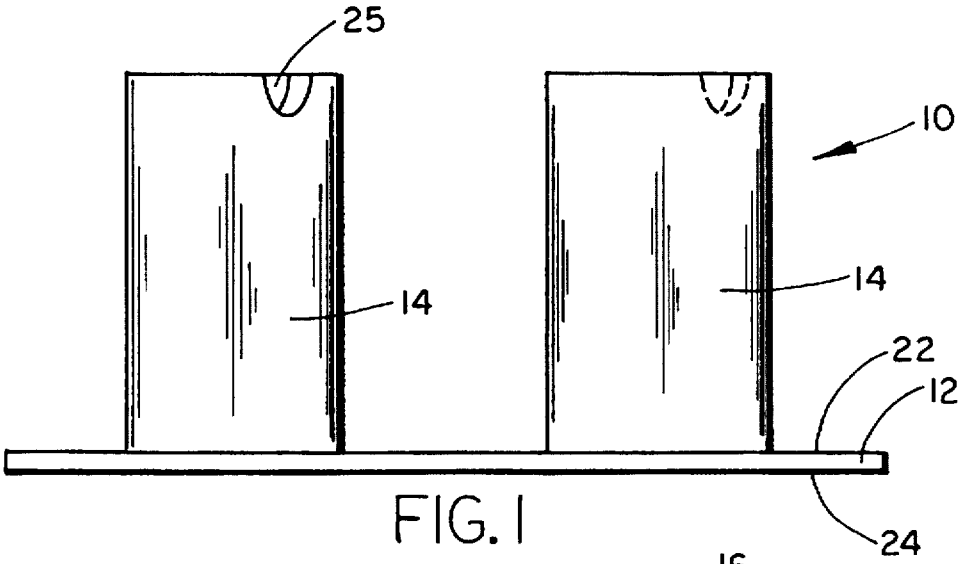
FIG. 1 is a side elevational view of a tube sealer embodying the invention.

Generally, the tube sealer 10 embodying the invention configured is generally comprised of a base member 12 and at least one tubular receptacle 14 configured to hold the tip of a tubular dispenser 30. A liquid 18 is contained by each tubular receptacle 14. A receiver 16 is provided at the bottom of each tubular receptacle 14 to receive the opened tip of the tubular dispenser.

Figure 2:
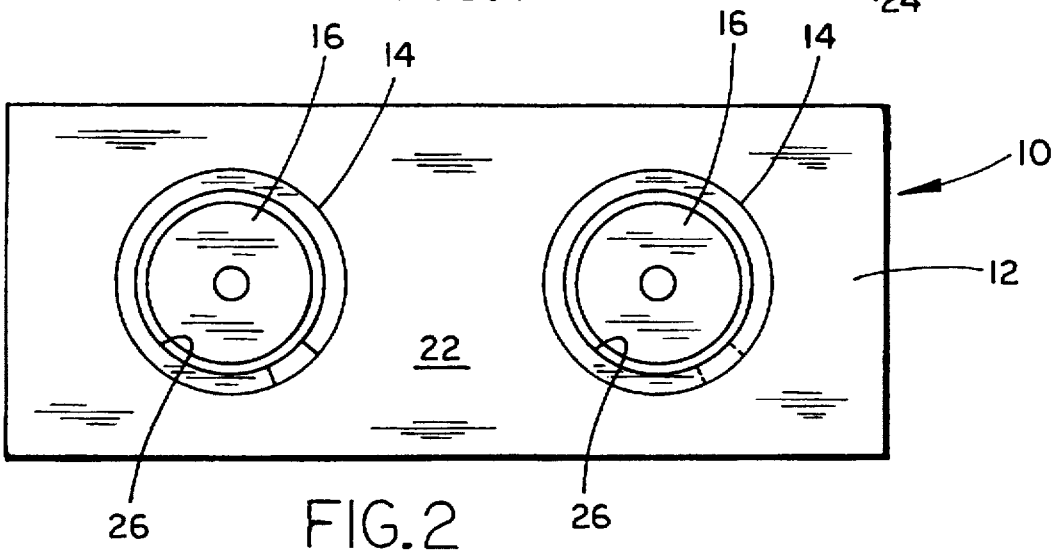
FIG. 2 is a top plan view of the tube sealer.

More particularly, as shown in the drawings, one embodiment of the base member 12 is comprised of an upper surface 22 and a lower surface 24. The base member 12 as shown in FIG. 2 has a rectangular configuration in plan and a length greater than the width. The base member 12 can be formed of a suitable material such as wood or plastic and may be a different shape. Preferably, a plurality of receptacles 14 are secured to upper surface 22 of base member 12 in spaced apart positions. In the embodiment shown in the drawings, two tubular receptacles 14 have been provided. More or less than two tubular receptacles 14 may be used, if desired. The receptacles 14 are best secured to the base member by an adhesive, but may be secured by other means as will become apparent below. Receptacles 14 preferably have a cylindrical shape, but may also have other shapes, for example, rectangular, if desired. Tubular receptacles 14 are preferably formed from an unreactive material such as plastic, and in particular, polyvinyl chloride, although other materials may also be used. One or more receptacles 14 may also include one or more notches 25 that can be used to aid the user in wiping excess fluid from the tip of the caulk tube.

Referring to FIG. 2, receptacles 14 have recesses 26 therein, also cylindrical in shape. Receptacles 14 and recesses 26 may extend at a 90 degree angle from base member 12, but may extend at other angles depending upon the mounting orientation of base 12. Recesses 26 are each of a height and diameter to receive a tube 30 to be stored therein.

Disposed within each receptacle 14 may be a disk insert 16 as a means to receive and secure tube tip 32. A receiver hole 28 is preferably formed in each disk insert 16 where hole 28 is of such a size as to receive tube tip 32. Disk insert 16 may be secured to base member 12 or to recess 26 of tubular receptacle 14 by the same adhesive used to secure receptacles 14 to base member 12. The diameter of the disk is preferably close to the inside diameter of recess 26 to minimize movement so that tube tip 32 can easily be placed inside hole 28 for storage. Disk insert 16 may also be made of the same unreactive material as the base member and receptacle.

Figure 3:
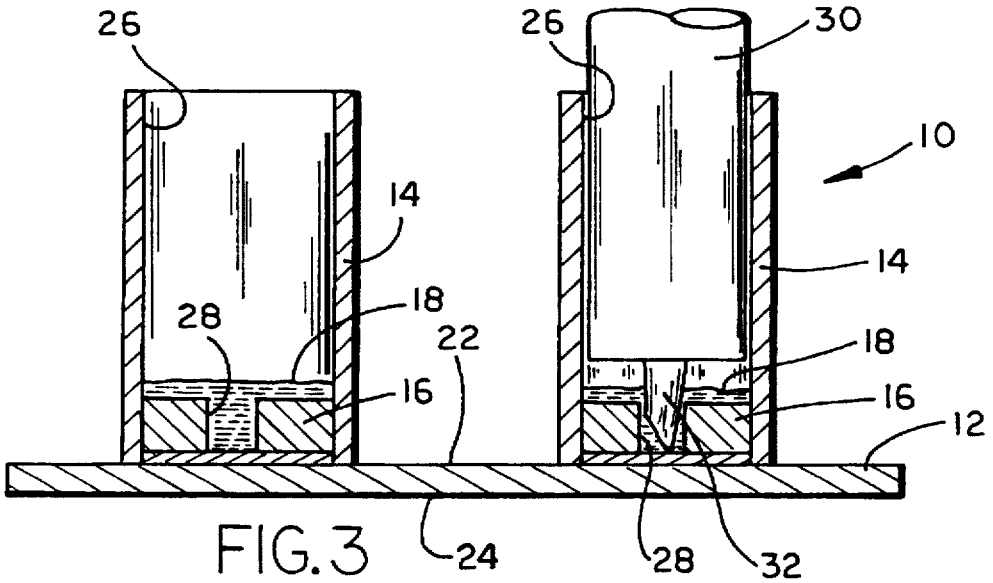
FIG. 3 is a cross-sectional elevational view through the center line of the embodiment of FIG. 2 with one tubular dispenser in position.
Figure 4:
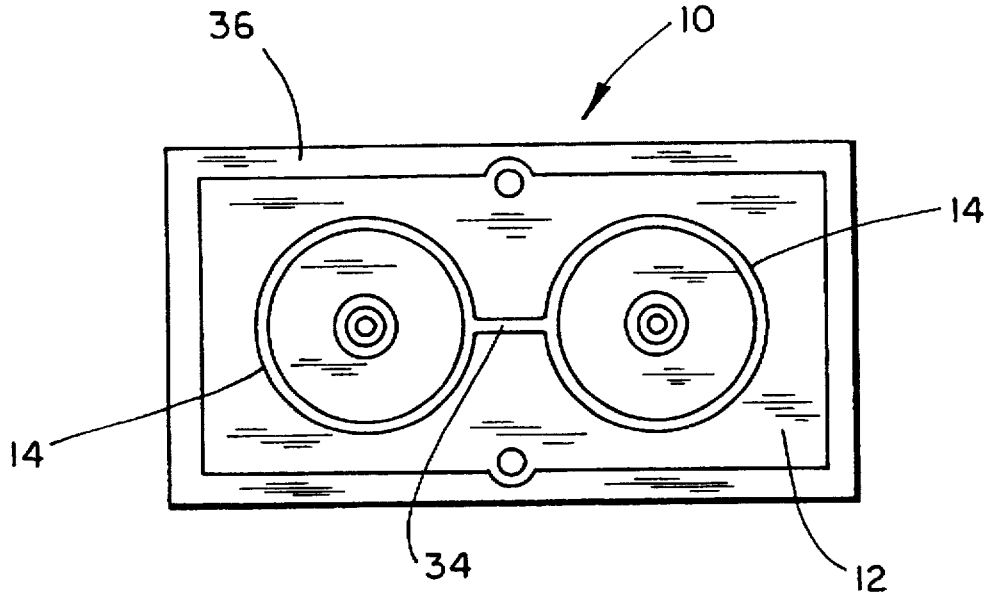
FIG. 4 is top plan view of an alternative embodiment of the tube sealer.

As shown in FIG. 3, liquid 18 fills each tubular receptacle 14 to a height such that liquid 18 covers the entire opening in tube tip 32. Examples of suitable liquids include materials having low vapor pressures such as motor oil and the like. It is contemplated that a petroleum-based product such as 200 weight oil will work best because its viscosity prevents wicking up the spout or nozzle of the caulk tube. Water may also be used, but is not preferred because it evaporates more rapidly than oil based liquids and has a tendency to wick up the nozzle. Liquid 18 should be at a suitable depth to prevent air from reaching the compound within the tube.

Other than tube sealer 10 disclosed above, the receptacles may be mounted to the base in an angular orientation to enable the base to be mounted on a wall or other vertical structure. In this embodiment, the disk members may be modified or have an angular surface such that the hole is oriented along the axis of the receptacle as opposed to being perpendicular to the base member.

Figure 5:
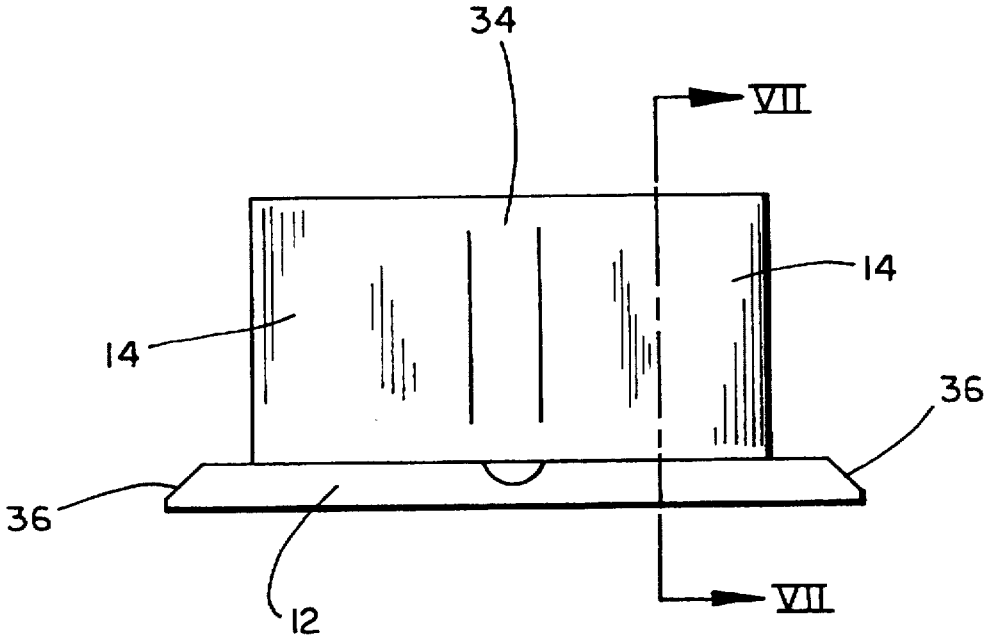
FIG. 5 is a side elevational view of the alternative embodiment of the tube sealer.

An alternative and preferred embodiment of the invention is shown in FIGS. 4–7. In the alternative embodiment, tube sealer 10 is a single piece, which is made using a conventional molding technique such as injection molding. In the illustrated embodiment, shown in FIG. 4, two tubular receptacles 14 are used which are connected to each other by a common web 34 which is molded to each receptacle 14 to add support to the tube sealer structure. Web 34, as shown in FIG. 5, is the same height as receptacles 14, but may be taller or shorter if desired.

Figure 6:
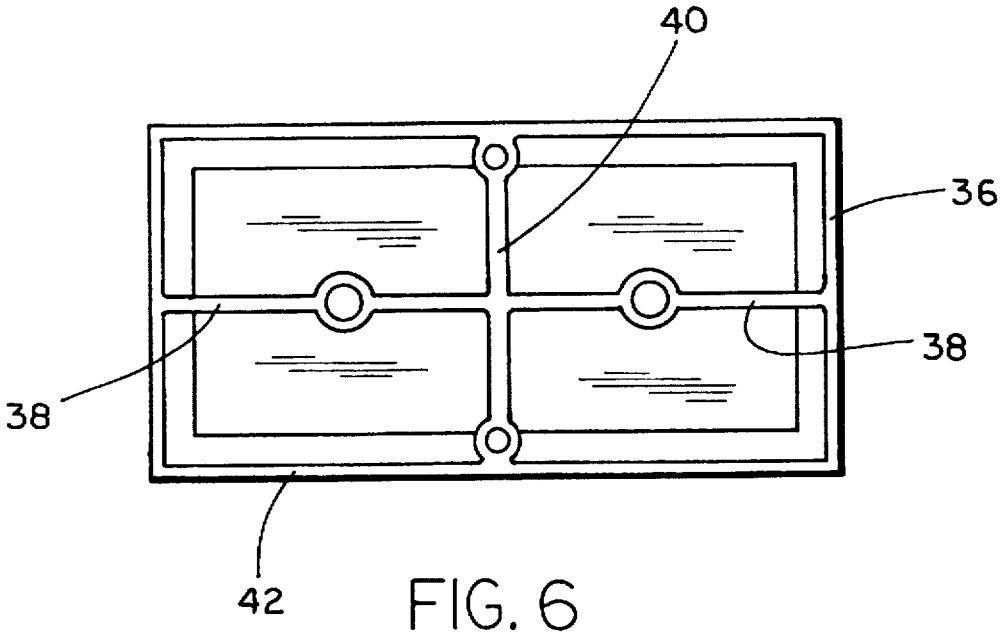
FIG. 6 is a bottom plan view of the alternative embodiment of the tube sealer.

The base member 12 supporting receptacles 14 has tapered edges 36, is generally hollow and includes one longitudinal support member or boss 38 and one transverse support member or boss 40 which, along with tapered edges 36, comprise the entire bottom surface of the base member, as shown in FIG. 6. This results in a durable but lightweight configuration.

Figure 7:
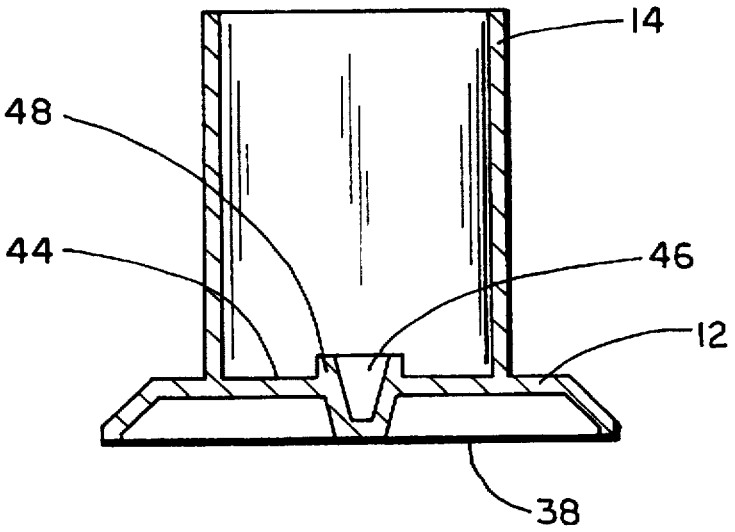
FIG. 7 is a cross-sectional view of the alternative embodiment taken along line VII—VII of FIG. 5.

FIG. 7 shows that each receptacle 14 in the alternative embodiment is a single molded piece, and integrally molded with base member 12. Bottom 44 of receptacle 14 includes a receiver 16 which is a conical recess 46, the walls of which extend to, and are attached to, longitudinal support member 38. Walls 48 define conical recess 46 and extend upwardly above the bottom of receptacle 14.

The base member 12 may further include one or more mounting structures such as one or more holes where each hole is adapted to receive a screw. The base member 12 may also include a means to allow the tube sealer to be hung from a peg board. Additionally, the base member may include double-stick tape to be used as an attachment means.

In operation, the base member and the receptacles are manufactured from unreactive materials and assembled generally as shown. Each receptacle is then filled with the amount of liquid sufficient to immerse the open tip of the tube when stored therein. The liquid surrounding the tube tip prevents the air from contacting the compound in the tip of the tube and drying out the compound therein. When the operator wants to reuse the tube, he simply withdraws the tube from the receptacle and wipes the excess liquid from the tip first with the aid of notch 25, and perhaps later with a rag. The inside of the tip may be cleaned by dispersing a small amount of material therein prior to use.

It will become apparent to those skilled in the art that various modifications to the preferred embodiment of the invention as described herein can be made without departing from the spirit or scope of the invention as defined by the appended claims.

The above description is considered that of the preferred embodiments only. Modification of the invention will occur to those skilled in the art and to those who make and use the invention. Therefore, it is understood that the embodiments shown in the drawings and described above are merely for illustrative purposes and are not intended to limit the scope of the invention, which is defined by the following claims.

I claim:

1. A device for sealing an opened tip of a tubular dispenser, comprising:

at least one receptacle formed of a tube open at a top and closed at a bottom, said bottom being flat with a receiver disposed therein, said receptacle, said bottom, and said receiver being formed of a single piece and holding a liquid, said receptacle configured to receive the tip end and the receiver configured to receive the tip of the tubular dispenser, whereby said liquid prevents air from contacting the opened tip of the tubular dispenser; and said receiver defined by a wall forming a recess extending above and below said receptacle bottom, said receptacle extending above said receiver to retain said tubular dispenser in a generally upright position.

2. The device as set forth in claim 1, further comprising a base member wherein at least one receptacle is secured.

3. The device as set forth in claim 2, further comprising said receptacle at a 90-degree angle to the base member.

4. The device as set forth in claim 1, wherein said tubular receptacle is cylindrical.

5. The device as set forth in claim 1, wherein said receiver is a conical-shaped recess.

6. The device as set forth in claim 1, wherein said receptacle is made of plastic.

7. A device sealing an opened tip of a tubular sealant dispenser, comprising:

at least one cylindrical receptacle formed of a tube open at a top and closed at a bottom said bottom being flat with a receiver disposed therein, said receptacle, said bottom, and said receiver being formed of a single piece and holding a liquid, said receptacle receiving the tip end and the receiver receiving the tip of the tubular sealant dispenser, wherein said liquid prevents air from contacting the opened tip of the tubular dispenser;

said receiver defined by a wall forming a recess extending above and below said receptacle bottom, said receptacle extending above said receiver and supporting said tubular dispenser in a generally upright position; and a tubular sealant dispenser in said receptacle.

8. The device as set forth in claim 7, further comprising said receptacle at a 90-degree angle to the base member.

9. The device as set forth in claim 7, wherein said receiver is a conical-shaped recess.

10. The device as set forth in claim 7, wherein said receptacle is made of plastic.

11. A device for sealing an opened tip of a tubular dispenser, comprising:

at least one cylindrical receptacle formed of a tube open at a top and closed at a bottom, said bottom being flat with a receiver disposed therein, said receptacle, said bottom, and said receiver being formed of a single piece and holding a liquid, said receptacle configured to receive the tip end and the receiver configured to receive the tip of the tubular dispenser, whereby said liquid prevents air from contacting the opened tip of the tubular dispenser;

a base member wherein at least one receptacle is secured;

said receiver defined by a wall forming a recess extending above and below said receptacle bottom; and said receptacle made of plastic and extending above said receiver to retain said tubular dispenser in a generally upright position.

* * * * *